US005178349A

United States Patent [19]

Marengo

[11] Patent Number: 5,178,349

[45] Date of Patent: Jan. 12, 1993

[54] RAILROAD SIGNAL SYSTEM

[75] Inventor: Dominick Marengo, Bronx, N.Y.

[73] Assignee: Comstock Group, Inc., Danbury, Conn.

[21] Appl. No.: 145,973

[22] Filed: Jan. 20, 1988

Related U.S. Application Data

[63] Continuation-in-part of Ser. No. 894,300, Aug. 7, 1986, abandoned.

[51] Int. Cl.[5] ..... A47G 29/00

[52] U.S. Cl. ..... 246/126; 246/246; 246/292; 246/473.1

[58] Field of Search ..... 246/176, 126, 220, 253, 246/246, 249, 294, 292, 208, 473.1, 473.2, 473.3; 340/916, 47, 48

*Primary Examiner*—Alvin E. Oberley
*Assistant Examiner*—Kara Farnandez
*Attorney, Agent, or Firm*—Kane, Dalsimer, Sullivan, Kurucz, Levy, Eisele and Richard

[57] ABSTRACT

An improved railroad signal system is described in which a train is allowed to approach a block even if a red light is activated for the block. A white numbered light is activated indicating the maximum permissible speed of the train. The system includes a home clearing relay and a station timing relay which are activated by two separate circuits thereby eliminating a wire loop.

1 Claim, 2 Drawing Sheets

BLOCK A
BLOCK B
BLOCK C
BLOCK D

LC
VC
STR
TP
LB
VB
AC
AC-B
AC-C
AC-B10
AC-C10
SIGNAL

RAILROAD SIGNAL SYSTEM

This Application is a continuation-in-part of U.S. application Ser. No. 894,300 filed Aug. 7, 1986 and now abandoned.

BACKGROUND OF THE INVENTION

1. Field of the Invention

This invention pertains to an improved railroad signal system having standard red, yellow, and green lights as well as a white numbered aspect light, the numbered light indicating when a red light will change to yellow when approached at an allowable speed.

For a better understanding of the invention, a typical prior art signalling circuit is first described. It should be understood that in the following discussion only the elements directly associated with the invention are mentioned. The signalling system has various other components which have been omitted for the sake of clarity.

2. Description of the Prior Art

Railroad signal systems with red, yellow and green lights have been used extensively for a long time. In such systems usually a train could not pass a red light. The red light was indicative of a train in the adjacent blocks ahead. However, while this type of system was very safe, in congested areas it was impractical because it caused consecutive trains to be too far apart thereby increasing the minimum headway. This disadvantage was especially acute in railroads used for urban or suburban mass transportation such as subways. Therefore a modified system has been introduced in which at least one of the signal light housings included a white numbered light in addition to the standard red, yellow and green lights. The white numbered light also had a preselected speed associated therewith. This white numbered light indicates to the train operator that the signal would change from red to yellow and the light could then be passed at the preselected speed displayed by the white numbered light without the train being tripped. This type of modified system has been in use by the New York City Transit Authority. However, as shall be described more fully below, the system presently in use has a number of disadvantages. First, it requires an extra wire loop between signal housings. This loop increases the possibility of shorts in the wire especially since the wire has to pass frequently from one crowded terminal box to another, where it could be pinched easily. Thus, wire looping reduces the integrity and safety of the signal system. It is design policy to eliminate wire looping circuits where feasible. Also, the additional wire increases the cost of installation, maintaining and trouble shooting the system.

OBJECTIVES AND SUMMARY OF THE INVENTION

In view of the above, it is an objective of the invention to provide a safer system which is considerably more efficient since it reduces cable and installation costs. Another objective is to provide a signal system which is easier to maintain and trouble shoot without any detrimental effects on the system's performance. Other advantages of the invention shall become apparent from the following description of the invention.

In accordance with this invention, two separate circuits are used for operating the home clearing relay coil and the station timing relay coil. Previously the relay coil wires operated by a common circuit. By using two separate circuits, a wire loop is saved as shall be demonstrated below.

GLOSSARY OF TERMS

Figure 1:
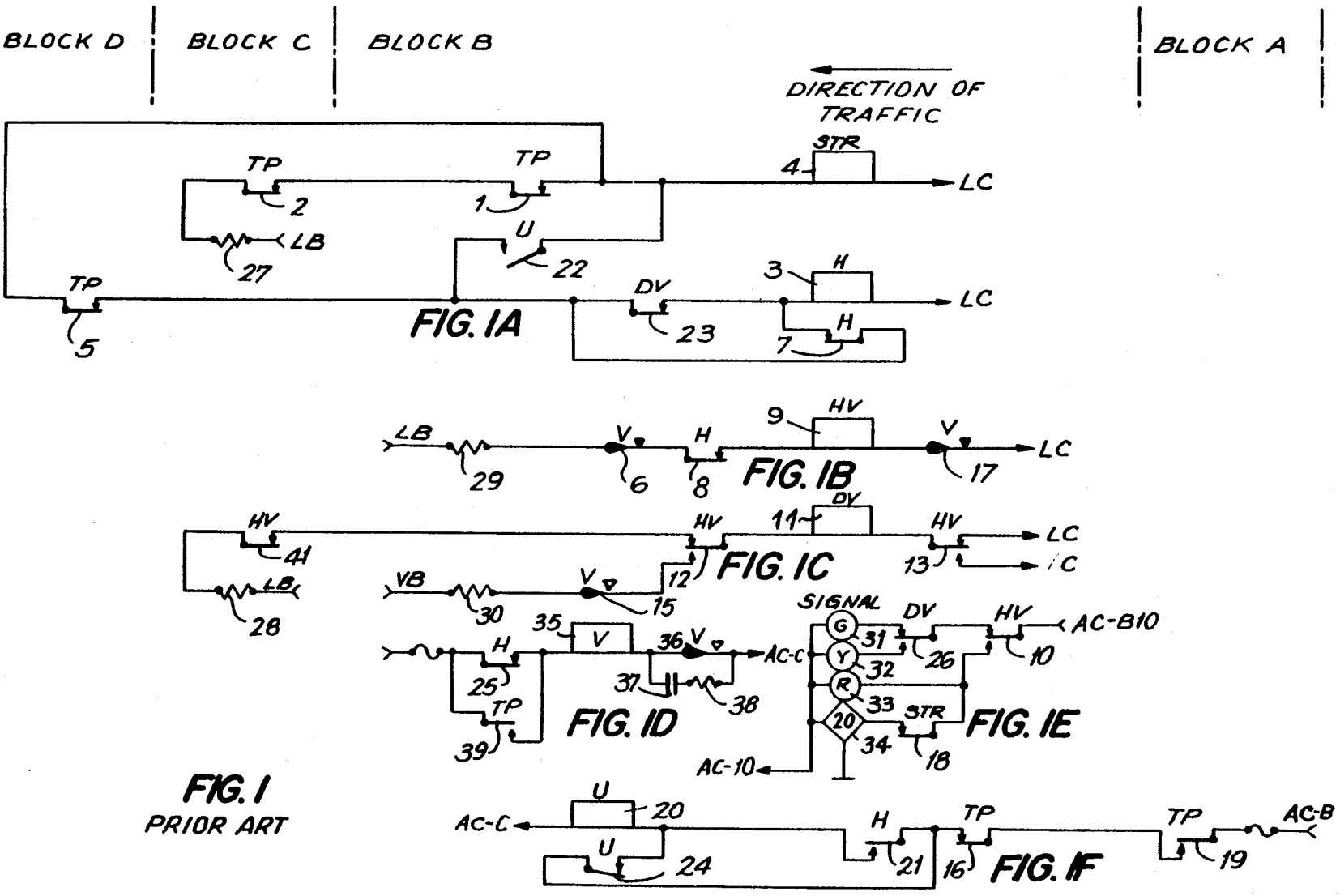
FIG. 1 PRIOR ART
FIGS. 1A–1F are circuit diagrams of a relevant prior art system.

1. BLOCK - LENGTH OF TRACK BETWEEN SIGNALS
2. 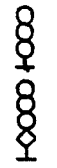 SYMBOL FOR SIGNAL HEAD DISPLAYING ASPECTS GREEN-YELLOW-RED
3. SYMBOL FOR SIGNAL HEAD DISPLAYING ASPECTS GREEN-YELLOW-RED- ALLOWABLE SPEED IN M/P/H
4. 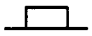 RELAY COIL
5. 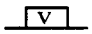 TRIP STOP MECHANISM
6. LB — 18 VOLTS D.C. BATTERY + (LINE)
7. LC — 18 VOLTS D.C. COMMON –
8. VB — 18 VOLTS D.C. BATTERY + (LOCAL)
9. VC — 18 VOLTS D.C. COMMON –
10. AC-B — 110 VOLTS A.C. +
11. AC-C — 110 VOLTS A.C. –
12. AC-B10 — 10 VOLTS A.C. +
13. AC-C10 — 10 VOLTS A.C. –
14. 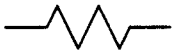 RESISTOR
15. 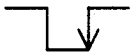 CLOSED FRONT CONTACT ON ENERGIZED RELAY
16. 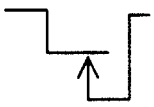 OPEN BACK CONTACT ON ENERGIZED RELAY
17. 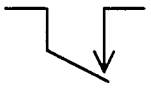 OPEN FRONT CONTACT ON DE-ENERGIZED RELAY
18. 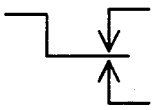 FRONT/BACK CONTACT ON ENERGIZED RELAY
19. 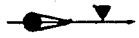 CLOSED CONTACT IN CLEAR TRIP STOP MECHANISM
20. 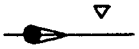 OPEN CONTACT IN CLEAR TRIP STOP MECHANISM
21. 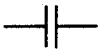 CAPACITOR
22.  FUSE

RELAY NOMENCLATURE

1. STR - STATION TIME RELAY
   FUNCTION - TO ILLUMINATE M/P/H ASPECT
2. H - HOME CLEARING
   FUNCTION - INSURES NO TRAIN IS IN BLOCK 'C' OR 'D' BEFORE BLOCK 'B' SIGNAL CAN DISPLAY

-continued

CAUTION, YELLOW ASPECT.

3. DV - DISTANT & STOPCHECK RELAY INSURES THAT A TRAIN HAS PASSED BLOCK 'D' BEFORE BLOCK 'B' SIGNAL CAN DISPLAY GREEN. CHECKS THAT THE TRIP STOP MECHANISM HAS CYCLED TO THE 'TRIPPING' POSITION.
4. HV - CHECKS H RELAY HAS ENERGIZED AND TRIP STOP MECHANISM HAS CLEARED BEFORE ALLOWING SIGNAL TO CLEAR.
5. U - TIMER RELAY SET AT PREDETERMINED TIME TO ALLOW BLOCK 'B' SIGNAL TO CLEAR BY APPROACHING TRAIN IN BLOCK 'A'.
6. TP - ENERGIZED WHEN ITS BLOCK IS UNOCCUPIED BY A TRAIN.
7. V - TRIP STOP MECHANISM - MOTOR OPERATED.

DETAILED DESCRIPTION OF THE INVENTION

With regard to prior art FIGS. 1A–E, let us assume that there are no trains in blocks B, C and D. Block D is a station stop block. Under this condition, the signal housing in block B displays a green signal 31 (FIG. 1E). Under the operating rules, a green signal conveys to the train operator the information to operate the train at the maximum allowable speed.

With blocks B, C and D unoccupied by a train, the front contacts of the TP relay 1, 2 and 5 which detect the presence of a train, (coil not shown) are in their energized and closed position.

As a train passes from Block A to Block B the Block B TP relay (train sensing relay) deenergizes thereby opening contact 1 in Block B and deenergizing the H relay 3 (home clearing relay) and STR (station timing relay) relay 4. The TP relay contact 39 (FIG. 1D) closes around the H relay contact 25 retaining energy to the V stop motor 39. The H relay contact 25 opens just after the TP relay 39 contact has closed insuring that the trip mechanism will remain in the clear position while the train is passing over that section of track in Block B.

The H relay contact 8 opens and deenergizes the HV (homestop) relay 9 (FIG. 1B). In the signal light circuit (FIG. 1E), the HV relay single pole double throw contact arrangement 10 opens its front contact and closes its back contact causing the green light to go dark and illuminating the red light.

The DV (distance stop) relay 11 deenergizes when the HV relay contact arrangements 12 and 13 open their front contacts and close their back contacts. With the trip stop still in its clear position, V contact 15 in the DV circuit (FIG. 1C) is still open thereby preventing VB energy from energizing the DV relay 11.

As the train progresses from Block B to Block C, the sequence of relay operation in Block C is similar to that previously described for the relays in Block B. When the train has proceeded out of Block B, the TP relay in Block B energizes causing contacts 1 and 16 (FIG. 1F) to close and 39 to open. When contact 39 opens, the V stop motor 35 deenergizes causing the trip stop to come up. (In the event a train passes a red signal with the trip stop up, the trip stop will engage the air brake valve 'not shown' located on the underside of the train, exhausting the air in the brake line which applies emergency braking.) The DV relay 11 becomes energized through the V contact 15, the trip stop now in tripping position, in series with HV relay contacts 12 and 13 back contacts-fed from local VB energy. This circuit insures the cycle check of the trip stop to its tripping position for each passage of a train.

As the train progresses to Block D and no longer occupies Block C the Block B signal will remain red because the TP relay contact 5 in Block D is open and still causing the circuit to the H relay coil to remain open. At this stage, a train in Block A approaching Block B will come up against a red signal and a V tripping stop 35, at the Block B signal. Under this condition, the Station Time feature, which will allow the train in Block A to pass the Block B signal at the allowable calculated safe speed, will take effect as follows:

With the first train in the station Block D, TP relay contact 5 is open. In Block B the H relay remains deenergized. The STR relay energized through TP relay contact 2 when the train left Block C, and is in series with TP relay contact 1. The V trip stop 35 remains deenergized in its tripping position and the signal at Block B displays a red light 33 with the 20 speed sign 34 illuminated through the STR relay contact 18 (FIG. 1-E) in series with the still deenergized HV relay contact 10. The approaching train in Block A causes the TP relay contact 19 to close in its deenergized position, energizing the U timer relay 20 (which has been preset to close its contacts at the allowable safe time) and by being in series with TP relay contact 16 which is closed, because no train is in Block B, and in series with H relay contact 21 which is deenergized because Block D is still occupied. When the U relay closes its contacts after the preset time has elapsed, U contact 22 in Block B closes placing a shunt across the TP relay contact 5 in Block D which is open due to the first train still occupying the station, Block D. The relay contact 22 closes the circuit to the H relay 3 through TP relay contacts 1 and 2 and DV relay contact 23. As the H relay energizes, the contact 21 opens in the U circuit. However, the U relay contact 24 shunts out the H relay contact 21 keeping the U relay energized. The H relay contact 25 energizes the V stop motor circuit 35 in series with contact 36 which is closed when the trip stop is in its tripping position. Contact 36 opens when the trip stop clears but is shunted out by the capacitor 37 and resistor 38, thus retaining energy to the stop motor. The HV relay 9 becomes energized through the H relay contact 8 in series with the V contact 6 when the trip stop clears. The DV relay 11 deenergizes when the HV contacts 12 and 13 are energized and the HV contact 41 in block C is open with Block D occupied. The HV relay contact arrangement 10 opens its back contact and closes its front contact causing the red light and the speed sign to go dark and illuminating the yellow (caution) light 32 in series with the deenergized DV relay contact 26. The operator of the second train in block A may now proceed at the prescribed speed into block B.

Power resistors 27–30 respectively found in FIGS. 1A, 1B, and 1C function in the usual manner.

Figures 2, 2A, 2B, 2C, 2D, 2E:
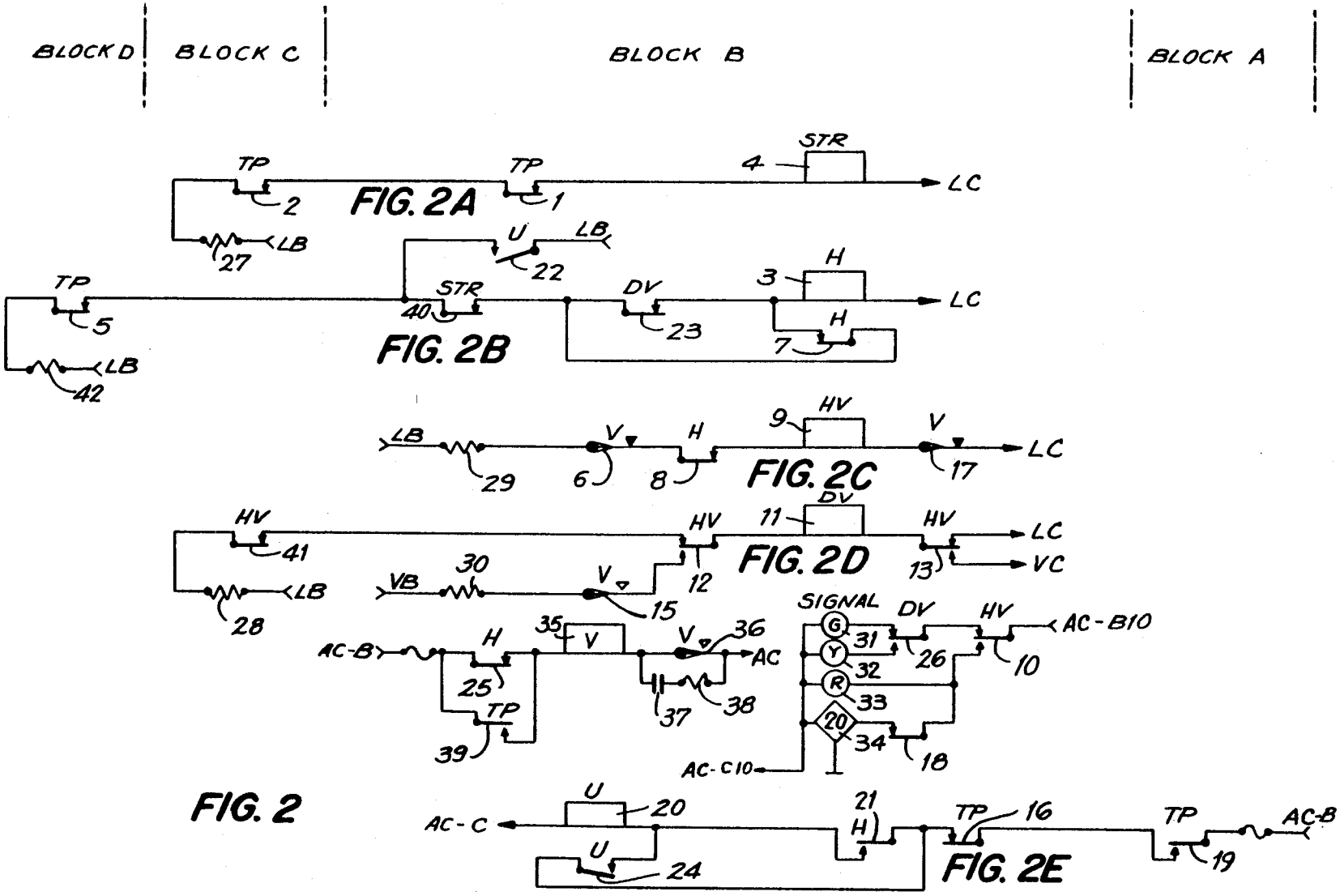
FIGS. 2A–2E are circuit diagrams of a preferred embodiment of the invention.

FIGS. 2 A–F, which show a preferred embodiment of the invention, consists of the circuit redesign for the STR and H relay coils. This redesign includes two separate circuits thereby eliminating a wire loop circuit. The wire loop circuit for the prior art circuit of FIG. 1 is less "fail safe" than the redesign shown on FIG. 2. The same reference numerals have been used for elements in FIG. 2 equivalent to those of FIG. 1.

The control circuit logic for both the H and STR relay coils contains the same relay contact logic as the prior art of FIG. 1 previously explained. The control circuits for the HV, DV, U relay coils and the signal housing and the V motor all remain as in prior art FIG. 1 and require no change.

In FIG. 2 the STR relay coil 4 is controlled from TP relay contact 2 in Block C in series with contact 1 in block B (FIG. 2A). The H relay coil circuit 3 has an independent control circuit beginning in block D (FIG. 2B). The TP relay contact 5 is in series with the STR contact 40. The STR relay contact 40 represents equivalent logic to the TP relay contacts 1 and 2, in the prior art FIG. 1 for the control of the H relay coil 3. The U relay contact 22, when required as in the prior art FIG. 1, shunts out the TP relay contact 5 in Block D. The remainder of the H relay coil circuit remains as explained for the prior art FIG. 1A.

This improved railroad signal design has certain advantages herein listed in order of importance:

1. It is "fail safe" because it eliminates a wire loop circuit, thereby reducing the probability of an accidental shunt of the safety contacts where wires leave block D or block C in the H coil control circuit.

2. It is economically superior. The redesign of FIG. 2 shows one less working wire in the cable between block B and block C and one less working wire between block C and block D. The required use of "station time" circuitry for the efficiency of train operation is usually combined for at least three consecutive signals as typified by the station time signal for Block B. Therefore the reduction of working wires in the aforementioned cables is at least two for each "station time" signal. On a design and installation contract there could be over eighty "station time" signals which would multiply the savings into thousands of dollars in cable alone.

3. Installation costs are appreciably reduced by the reduction in size of the cables. This reflects back to a reduction in the size of the messenger upon which cable is hung, reducing messenger costs. Cable terminations are eliminated in each "station time" relay case by the reduction in cable size.

4. The elimination of the loop circuit of the prior art reduces the terminations in the working H relay coil circuit by two. Each terminal represents a connection of two wires and increases the probability of an open circuit failure.

5. Trouble shooting of circuits is easier and more efficient with the reduction of wires and individual control of the STR and H relay coils.

Obviously numerous modifications can be made to the invention without departing from its scope as defined in the appended claims.

What is claimed is:

1. A railroad signal system comprising:

a first circuit for energizing a station timing relay, said station timing relay including a closed timing relay contact, and a timing relay coil, said first circuit including a train sensing contact connected in series with said timing relay coil and a first power feed line;

a second circuit for energizing a home clearing relay having a home clearing relay coil and a home clearing relay contact, with said closed timing relay contact being in series with said home clearing relay coil, and a second power feed line separate from the first power feed line; and a light circuit comprising a green, a yellow, a red and a white numbered light, said light circuit being coupled to said home clearing relay contact for alternately activating said lights.

* * * * *